US005129749A

United States Patent [19]

Sato

[11] Patent Number: 5,129,749

[45] Date of Patent: Jul. 14, 1992

[54] LINE PRINTER WITH PINCH ROLLER RELEASE

[75] Inventor: Katsuari Sato, Tokyo, Japan

[73] Assignee: Seiko Instruments Inc., Japan

[21] Appl. No.: 685,861

[22] Filed: Apr. 16, 1991

[30] Foreign Application Priority Data

Apr. 17, 1990 [JP] Japan ..... 2-41037[U]

[51] Int. Cl.[5] ..... B41J 15/00

[52] U.S. Cl. ..... 400/639; 400/617; 400/636; 271/274; 226/187

[58] Field of Search ..... 400/617, 634, 636, 636.3, 400/637, 637.1, 637.3, 637.4, 637.5, 637.6, 639, 641, 692; 271/272, 273, 274; 226/46, 47, 187, 198

[56] References Cited

U.S. PATENT DOCUMENTS 3,561,660 2/1971 Nicol ..... 226/187
4,346,883 8/1982 Speraggi ..... 271/274
4,522,520 6/1985 Takenoya et al. ..... 400/636.3
4,630,815 12/1986 Petersen et al. ..... 271/273
4,944,620 7/1990 Scozzafava et al. ..... 400/636

*Primary Examiner*—Edgar S. Burr
*Assistant Examiner*—Ren Yan
*Attorney, Agent, or Firm*—Bruce L. Adams; Van C. Wilks

[57] ABSTRACT

The line printer is provided with a pinch roller for feeding a spring medium sheet by capstan drive. The pinch roller is pressed by an integrated pressing mechanism comprised of a spring holder, a pressing spring member disposed in the holder and a bearing piece connected to the spring member in contact with the pinch roller. A pressing lever is shiftable between a pressing position effective to apply pressing force to the integrated mechanism and a release position effective to release the integrated pressing mechanism. The released pressing mechanism or unit is moved away from the pinch roller to free the same to leave a significant gap between the pinch roller and a capstan roller, thereby facilitating removal of a jammed print medium sheet. Further, the integrated pressing mechanism facilitates maintenance performance of the line printer.

4 Claims, 5 Drawing Sheets

LINE PRINTER WITH PINCH ROLLER RELEASE

BACKGROUND OF THE INVENTION

The present invention relates to line printers of the type feeding a print medium sheet by capstan drive.

Conventional, in the line printer constructed to feed a print medium sheet by capstan drive, a pinch roller pressing mechanism is constructed such that a link mechanism or cam mechanism is provided to impart pressing force to opposite ends of a pinch roller shaft.

However, in the conventional pressing mechanism, since the link or cam mechanism moves through a relatively shaft stroke, the pinch roller can be displaced only through narrow distance when the pressing force is released. Therefore, there may be caused drawback that a print medium sheet cannot be easily removed when jamming occurs around the pinch roller.

Further, the conventional pinch roller pressing mechanism is comprised of plural components separately mounted on a printer frame, thereby hindering easy maintenance of the printer.

SUMMARY OF THE INVENTION

In view of the above noted drawbacks of the prior art, an object of the invention is to provide a pinch roller release mechanism constructed to facilitate removed of jammed print medium sheets and comprised of integrated components.

In order to achieve the above object, the inventive mechanism is comprised of a transverse shaft fixed to a printer frame, a pressing spring member having one end which supports a bearing piece placeable in contact with a pinch roller shaft and another end which is engaged rotatable with respect to the transverse shaft through a spring holder which holds the spring member, and a pressing lever rotatable supported at its one end by the transverse shaft. The pressing lever is normally placed in a pressing position so as to urge the pressing spring member, and is rotatable shiftable from the pressing position to release the pressing spring member to free or remove the bearing piece.

In the above constructed pinch roller release mechanism, the spring holder, pressing spring member and bearing piece constitute together an integrated unit, which is operated by rotating the pressing lever counterclockwise so as to release pressing force from the pinch roller. The integrated unit and the pinch roller can be vertically moved away altogether to leave a given gap relative to a capstan roller, thereby facilitating removal of jammed print medium sheets and maintenance performance of the printer device to lower maintenance cost.

DETAILED DESCRIPTION OF EMBODIMENTS

Figure 1:
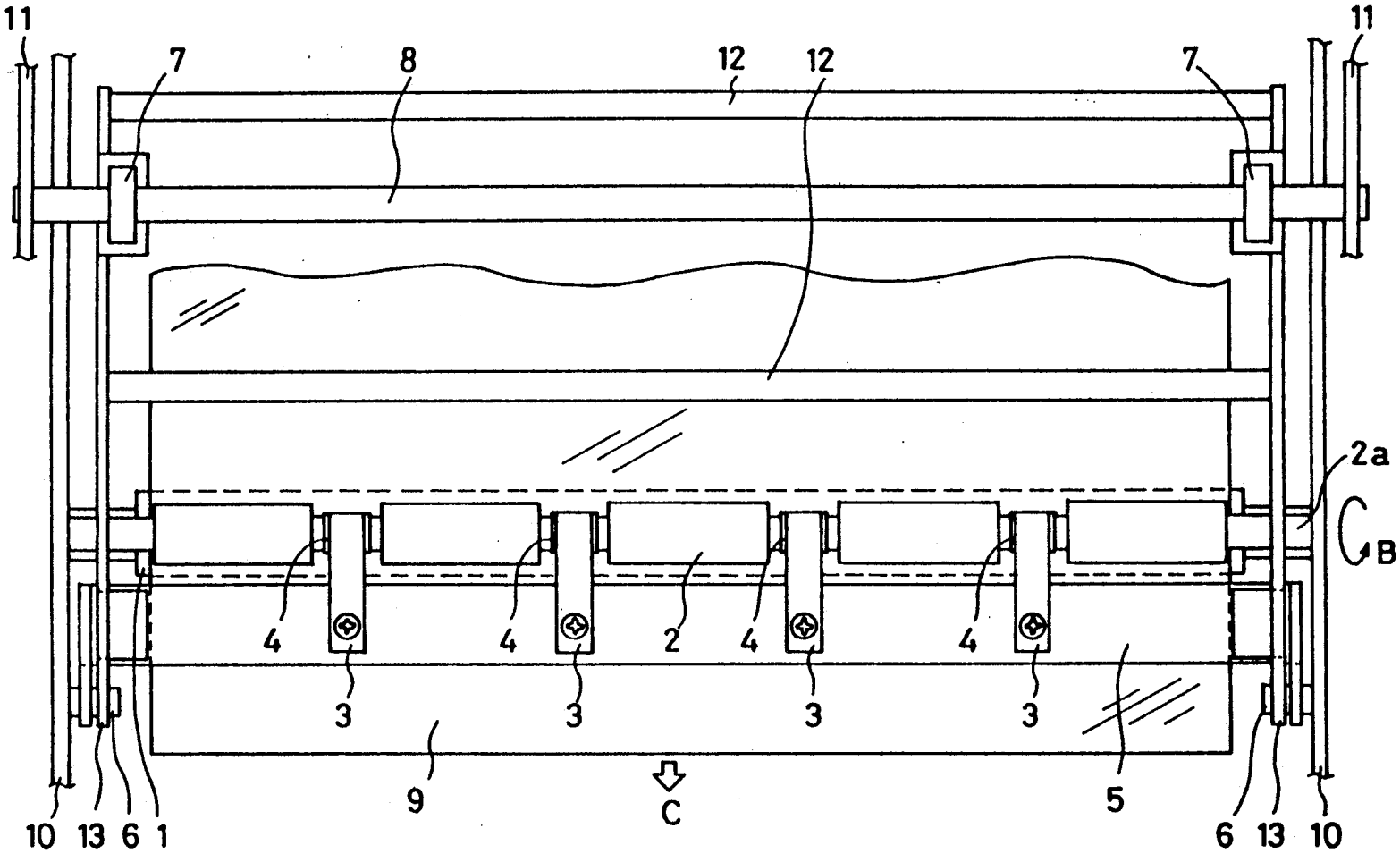
FIG. 1 is a partial plan view of the line printer to show a first embodiment of the pinch roller pressing mechanism according to the invention.
Figure 2:
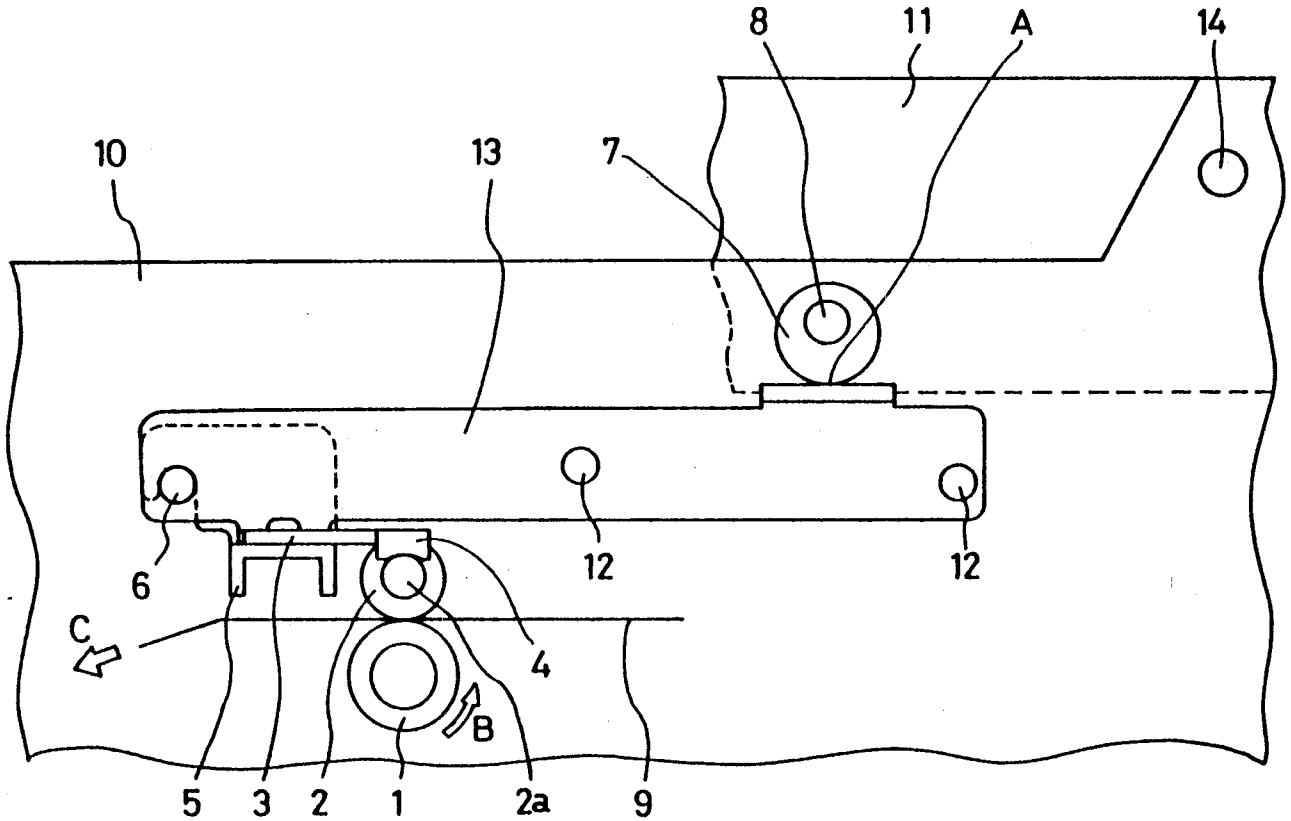
FIG. 2 is a partial side view of the FIG. 1 printer.

Hereinafter, embodiments of the present invention will be described in conjunction with the drawings. FIG. 1 is a plan view showing a pinch roller pressing mechanism in the pressing position according to the invention, and FIG. 2 is a partial side view of the FIG. 1 mechanism. In FIG. 2, an upper frame 11 is pivotably supported around a pivot shaft 14 disposed on a lower frame 10 such that the upper frame 11 can be held open or close relative to the lower frame 10. Though not shown in the figure, the upper frame 11 is provided with a hook engageable with a groove formed in the lower frame 10 to lock the upper frame 11 to the lower frame 10.

Referring to FIG. 1 and FIG. 2, a pressing lever 13 is rotatable supported around a transverse shaft 6 disposed on the lower frame 10. Further, a spring holder 5 has a U-shaped groove at its one end, and is rotatably supported by the same transverse shaft 6. A pressing spring 3 i the form of a leaf spring member is fixed at its one end to the spring holder 5 and is provided at its free or tip end with a bearing piece 4 such that the holder 5, spring 3 and bearing piece 4 constitute together a single integrated unit. As described before, the pressing or operating lever 13 and the spring holder 5 are coaxially rotatably supported around the transverse shaft 6. In such construction, the operating lever 13 is operated to act on the spring holder 5 to apply thereto a pressing force, and to move away from the spring holder 5 to release the pressing force.

A pressing cam 7 is fixed eccentrically around a cam shaft 8 which is rotatably supported on the upper frame 11. The pressing cam 7 has a convex portion A which comes in contact with the pressing lever 13 so that the pressing lever 13 is pressed downwardly around the transverse shaft 6 supported on the lower frame 10 so as to apply pressing force to the spring holder 5. By this operation, the pressing force is transmitted through four pressing springs 3 secured to the spring holder 5 and four bearing pieces 4 each fixed to the corresponding one of the springs 3, to a shaft 2*a* of the pinch roller 2. Consequently, the pressing force is uniformly distributed from the pinch roller 2 through a print medium sheet 9 to a capstan roller 1. Further, when the capstan roller 1 is rotated counterclockwise in the direction B, the print medium sheet 9 is transferred in the direction C by gripping force caused between the capstan roller 1 and the pinch roller 2. This gripping or pinching force is controlled by eccentricity of the convex portion A of the pressing cam 7. The cam shaft 8 is angularly displaced in synchronization with sheet feeding operation by a controller (not shown) to a given position. When feeding the sheet, as shown in FIG. 2, the pressing cam 7 fixed to the cam shaft 8 is positioned at the maximum stroke in contact with the pressing lever 13 to press down the same, thereby generating the pinching force between the capstan roller 1 and the pinch roller 2. When not feeding the sheet, the pressing cam 7 fixed to the can shaft 8 is angularly shifted away from the pressing lever 13 to thereby release the pinching force between the capstan roller 1 and the pinch roller 2.

Figure 3:
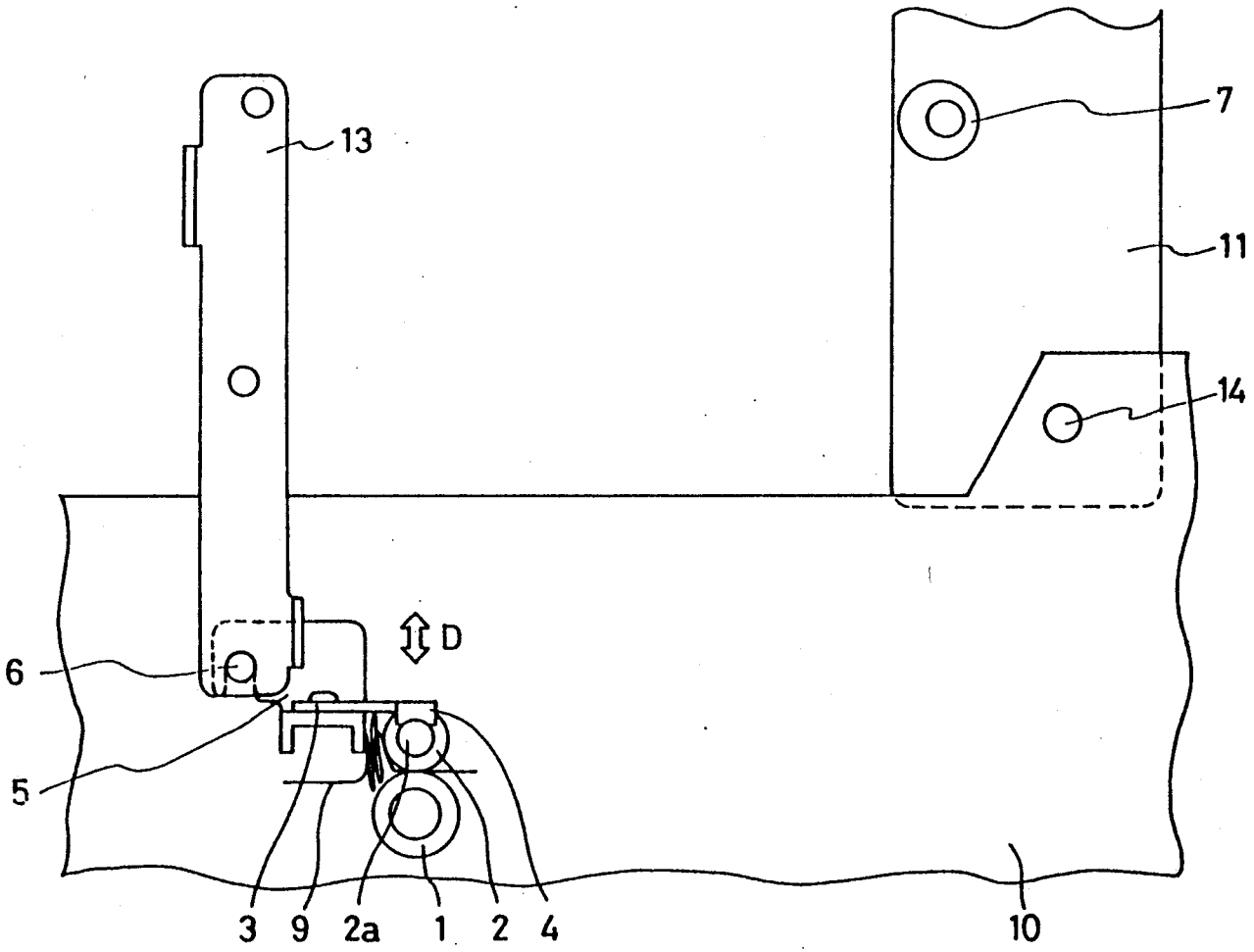
FIG. 3 is another partial side view of the FIG. 1 printer to show release state of the pressing mechanism.

FIG. 3 shows a released state in case of jamming of the print medium sheet 9 in the printer body. The upper frame 11 is clockwise pivoted around the pivot shaft 14 held on the lower frame 10 to open the upper frame 11. By this operation, the engagement is broken between the pressing cam 7 and the pressing lever 13. Further, the pressing lever 13 is angularly displaced counterclockwise by 90° around the transverse shaft 6. Consequently, the integrated unit of spring holder 5, pressing spring 3 and bearing piece 4 is made free and therefore is displaceable upward vertically in the direction D. Though not shown in the figure, the lower frame 10 is formed with a U-shaped bearing groove which is vertical to the pinch roller haft 2*a* and which rotationally supports the pinch roller shaft 2*a*. When the bearing piece 4 is removed, the shaft 2*a* is made free and therefore is displaceable upward a distance of 4 mm–5 mm in the direction D along the U-shaped bearing groove. Accordingly, the spring holder 5 etc. can be significantly moved away from the capstan roller 1, and the pinch roller 2 is also moved away from the capstan roller 1 to leave a sufficient gap therebetween, thereby facilitating removal of jammed print medium sheet 9 from the printer body. Then, such operation can be reversely carried out to restore the pressing state of the printer.

Figure 4:
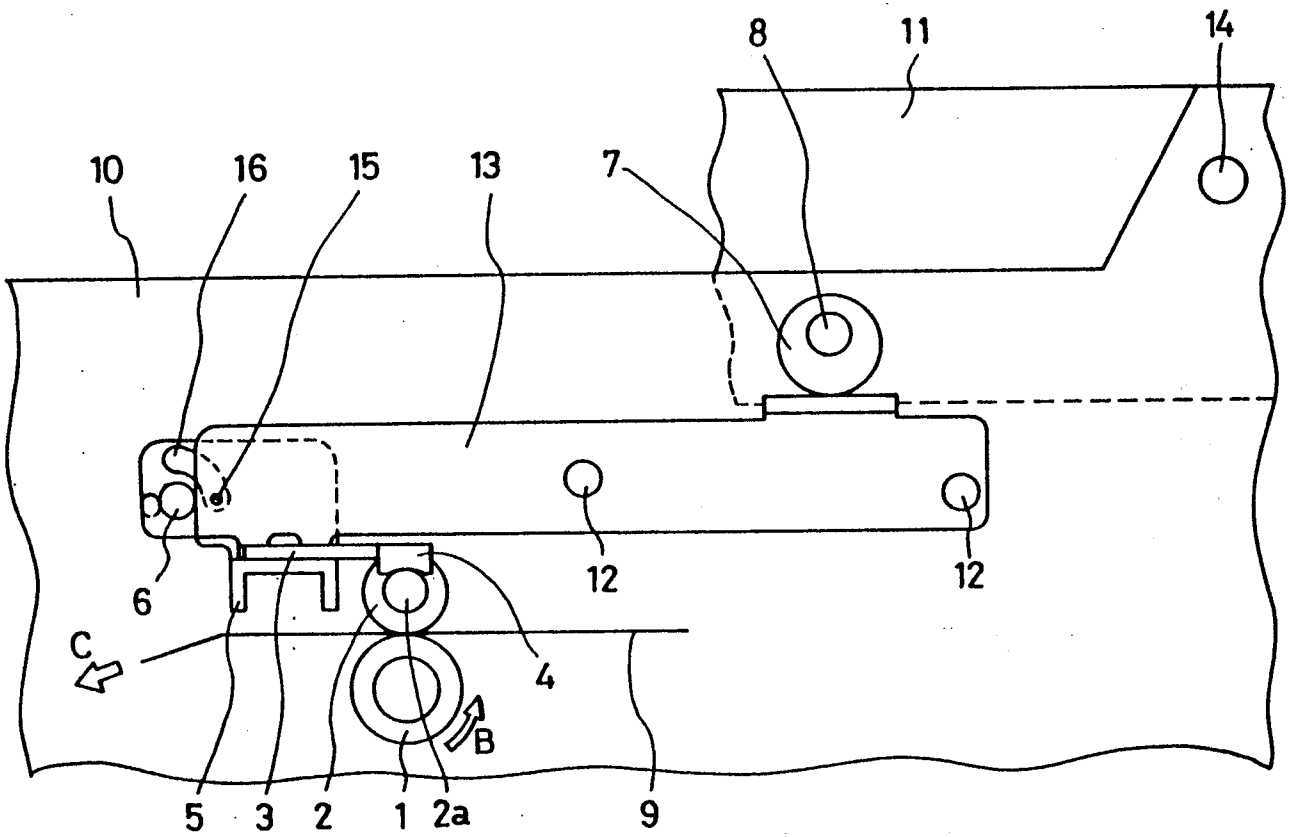
FIG. 4 is a partial side view showing a second embodiment according to the invention.
Figure 5:
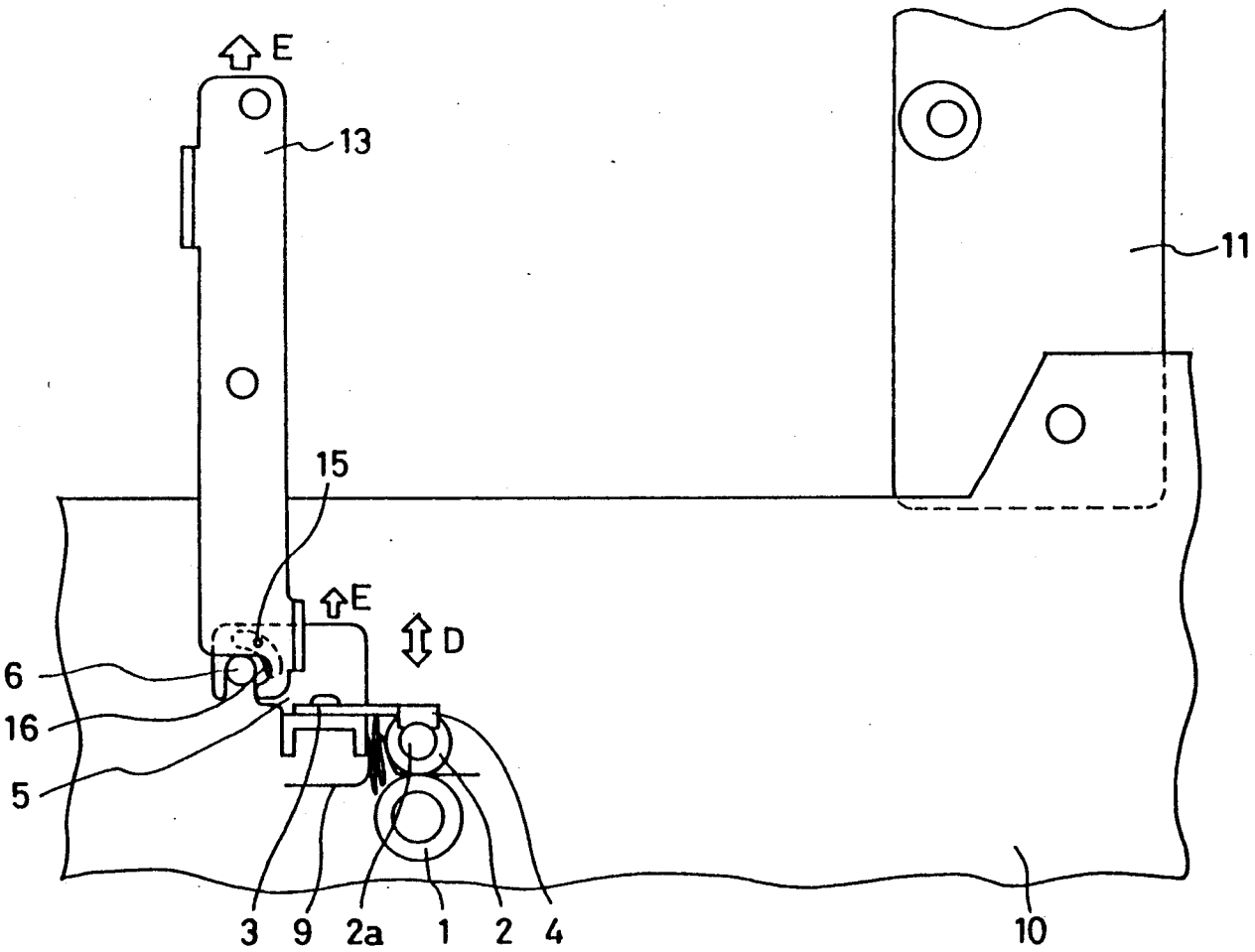
FIG. 5 is another partial side view of the second embodiment to illustrate its release state.

FIG. 4 and FIG. 5 show a second embodiment of the pinch roller pressing releasing mechanism. FIG. 4 indicates the pressing state. The pressing lever 13 is formed with a secured hook pin 15. Further, the pressing lever 13 is formed with a U-shaped groove through which the lever 13 is pivotably or rotationally supported by the transverse shaft 6. In manner similar to the first embodiment, the spring holder 5 is formed at its end with a U-shaped groove through which the holder 5 is pivotably or rotatably supported by the transverse shaft 6. In addition, the spring holder 5 is formed with an arc groove 16 into which is loosely inserted the hook pin 15 of the pressing lever 13. The arc groove 16 is shaped and dimensioned such that the hook pin 15 fixed to the pressing lever 13 can move through the groove 16 when the pressing lever 13 is angularly displaced counterclockwise from the FIG. 4 position to the FIG. 5 position.

FIG. 5 shows a released state in case that a print medium sheet 9 is jammed in the printer body. In similar manner to the previous embodiment, the upper frame 11 is made open and the pressing lever 13 is angularly displaced by 90° counterclockwise. Thereafter, the pressing lever 13 is displaced linearly rightward in the figure so that the pressing lever 13 is disengaged from the transverse shaft 6. Consequently, the pressing lever 13 can be detached vertically in the direction E. Further, when the pressing lever 13 is displaced in the direction E, the hook pin 15 comes in engagement with an edge of the arc groove 16 formed in the spring holder 5. Accordingly, the integrated unit of holder 5, spring 3 and bearing piece 4 is detached from the transverse shaft 6 in the direction E. Since the shaft 2*a* of the pinch roller 2 is set i the U-shaped groove (not shown) formed in the lower frame 10, the pinch roller shaft 2*a* is shiftable vertically a distance of 4 mm–5 mm, in similar manner to the first embodiment, in the direction D. Moreover, the adjacent components or parts are moved away, hence the jammed print medium 9 can be removed easily. In addition the pinch roller pressing releasing mechanism is integrally assembled in the printer body to thereby facilitate maintenance such as replacement of components.

As described above, according to the invention, the pinch roller pressing releasing mechanism can be made free to enlarge a gap between the pinch roller and the capstan roller four to five times as great as the conventional structure, thereby facilitating removal of jammed print medium sheet from the printer body. Further, the pressing releasing mechanism is integrally constructed and therefore can be detached entirely to facilitate maintenance and to lower the maintenance cost. Moreover, a plurality of the pressing springs support the individual bearing pieces so as to uniformly distribute the pinching force to the capstan roller through the print medium sheet.

What is claimed is:

1. A device disposed in a frame of a printer for pressing and releasing a pinch roller, comprising:

a transverse shaft fixed to the frame;

a spring holder rotatably mounted around the transverse shaft;

a pressing spring member having one end portion fixed to the spring holder and another end portion;

a bearing piece supported by said another end portion of the pressing spring member in contact relation with a shaft of the pinch roller; and a pressing lever having one end rotatably supported around the transverse shaft, the pressing lever normally being placed in a pressing position effective to urge the pressing spring member, and being angularly displaceable from the pressing position to a release position effective to release the pressing spring member to thereby free the bearing piece from the pinch roller.

2. A device according to claim 1; wherein the spring holder, the pressing spring member and the bearing piece constitute together an integrated unit displaceable away from the pinch roller when the pressing lever is placed in the release position.

3. A device according to claim 2; wherein the pressing lever is detachable from the transverse shaft in the release position, and has means in engagement with the integrated unit for disengaging the integrated unit from the transverse shaft when the detached pressing lever is moved away from the pinch roller.

4. A device according to claim 1; including another frame coupled to the first-mentioned frame, said another frame having cam means operable when feeding a print medium sheet to act on the pressing lever for applying pinching force to the pinch roller through the integrated unit.

* * * * *